US009689063B2

(12) United States Patent
Jang et al.

(10) Patent No.: US 9,689,063 B2
(45) Date of Patent: Jun. 27, 2017

(54) ELECTROMAGNETIC WIPING DEVICE, PLATED STEEL SHEET WIPING APPARATUS INCLUDING SAME, AND METHOD FOR MANUFACTURING PLATED STEEL SHEET

(71) Applicant: POSCO, Pohang-si, Gyeongsangbuk-do (KR)

(72) Inventors: Tae-In Jang, Gwangyang-si (KR); Jung-Kuk Kim, Gwangyang-si (KR); Chang-Woon Jee, Gwangyang-si (KR); Yong-Hun Kweon, Gwangyang-si (KR)

(73) Assignee: POSCO, Pohang-si, Gyeongsangbuk-do (KR)

( * ) Notice: Subject to any disclaimer, the term of this patent is extended or adjusted under 35 U.S.C. 154(b) by 282 days.

(21) Appl. No.: 14/368,875

(22) PCT Filed: Dec. 24, 2012

(86) PCT No.: PCT/KR2012/011378
§ 371 (c)(1),
(2) Date: Jun. 26, 2014

(87) PCT Pub. No.: WO2013/100518
PCT Pub. Date: Jul. 4, 2013

(65) Prior Publication Data

US 2014/0356548 A1 Dec. 4, 2014

(30) Foreign Application Priority Data

Dec. 26, 2011 (KR) ..... 10-2011-0142255

(51) Int. Cl.
*C23C 2/24* (2006.01)
*C23C 2/26* (2006.01)
(Continued)

(52) U.S. Cl.
CPC ..... *C23C 2/26* (2013.01); *C23C 2/003* (2013.01); *C23C 2/14* (2013.01); *C23C 2/20* (2013.01);
(Continued)

(58) Field of Classification Search
None
See application file for complete search history.

(56) References Cited

U.S. PATENT DOCUMENTS 3,518,109 A * 6/1970 Halley ..... C23C 2/24 118/639
2008/0044584 A1* 2/2008 Eriksson ..... C23C 2/20 118/419
(Continued)

FOREIGN PATENT DOCUMENTS

CN 101323940 12/2008
CN 101698927 A * 4/2010
(Continued)

OTHER PUBLICATIONS

Notice of Office Action with English language translation issued by the Japanese Patent Office on May 26, 2015, in counterpart Japanese Application No. 2014-549982.
(Continued)

*Primary Examiner* — Binu Thomas
(74) *Attorney, Agent, or Firm* — Finnegan, Henderson, Farabow, Garrett & Dunner, LLP

(57) ABSTRACT

There are provided an electromagnetic wiping device, a plated steel sheet wiping apparatus including the electromagnetic wiping device, and a method for manufacturing a plated steel sheet. A portion of a plating layer of a steel sheet having passed through a plating bath is preliminarily removed at least in an edge region of the steel sheet, and a gas wiping operation is performed. Therefore, overplating is
(Continued)

prevented at least in the edge region of the steel sheet. In addition, since the load of gas wiping can be reduced while maintaining the line speed of the steel sheet, the quantity of scattered particles and the formation of dross can be reduced for improving the plating quality of the steel sheet and the productivity of a manufacturing process.

8 Claims, 12 Drawing Sheets

(51) Int. Cl.

| | |
|---|---|
| ***C23C 2/20*** | (2006.01) |
| ***C23C 2/40*** | (2006.01) |
| ***C23C 2/14*** | (2006.01) |
| ***C23C 2/00*** | (2006.01) |
| *B05C 3/02* | (2006.01) |

(52) U.S. Cl.
CPC ..... *C23C 2/24* (2013.01); *C23C 2/40* (2013.01); *B05C 3/02* (2013.01)

(56) References Cited

U.S. PATENT DOCUMENTS

| | | | | |
|---|---|---|---|---|
| 2009/0098294 | A1 | 4/2009 | Malas | |
| 2009/0208665 | A1* | 8/2009 | Eriksson | C23C 2/20 118/639 |
| 2011/0177258 | A1* | 7/2011 | Ernst | C23C 2/24 335/219 |
| 2013/0180076 | A1* | 7/2013 | Jang | C23C 2/00 15/339 |
| 2013/0327806 | A1* | 12/2013 | Jang | C23C 2/40 226/196.1 |

FOREIGN PATENT DOCUMENTS

| | | | | |
|---|---|---|---|---|
| DE | 10240954 | | | 5/2004 |
| DE | 10240954 | A | * | 5/2004 |
| JP | 57-169076 | | | 10/1982 |
| JP | 61-266560 | | | 11/1986 |
| JP | 05-331610 | | | 12/1993 |
| JP | H05-331610 | A | * | 12/1993 |
| JP | 6-330275 | | | 11/1994 |
| JP | 08-199323 | | | 8/1996 |
| JP | 11-172400 | | | 6/1999 |
| JP | 11172400 | A | * | 6/1999 |
| JP | 2000-212714 | | | 8/2000 |
| JP | 2000-282207 | | | 10/2000 |
| JP | 2009-167473 | | | 7/2009 |
| KR | 10-2009-0035458 | | | 4/2009 |

OTHER PUBLICATIONS

English-language International Search Report from the Korean Patent Office for International Application No. PCT/KR2012/011378, mailing date Apr. 24, 2013.

First Office Action from the China Patent Office (SIPO) in counterpart Chinese Patent Application No. 201280070305.9, mailed Aug. 7, 2015.

Extended European Search Report from the European Patent Office in counterpart European Patent Application No. 12863129.8, mailed Aug. 10, 2015.

* cited by examiner

--Prior Art--

--Prior Art--

--Prior Art--

ELECTROMAGNETIC WIPING DEVICE, PLATED STEEL SHEET WIPING APPARATUS INCLUDING SAME, AND METHOD FOR MANUFACTURING PLATED STEEL SHEET

TECHNICAL FIELD

The present disclosure relates to a wiping device for controlling the quantity of a plating layer formed on a plated steel sheet, and more particularly, to an electromagnetic wiping device, a plated steel sheet wiping apparatus including the electromagnetic wiping device, and a method for manufacturing a plated steel sheet, designed to preliminarily remove a portion of a plating layer at least in an edge region of a steel sheet having passed through a plating bath and perform a gas wiping operation for preventing overplating in at least the edge region of the steel sheet, reducing gas wiping loads while maintaining the line speed of the steel sheet, reducing the quantities of scattered particles and dross, and improving the plating quality of the steel sheet and the productivity of a plating process.

BACKGROUND ART

Recently, demand for plated steel sheets, improved in terms of corrosion resistance and aesthetic appearance has increased, for example, for use in applications such as electrical appliances and automobiles.

For example, FIG. 1 illustrates hot dipping equipment such as hot-dip galvanizing equipment for galvanizing steel sheets.

Referring to FIG. 1, a steel sheet S (e.g., a hot-rolled steel sheet S) unwound from a pay-off reel is carried through a welder and a looper and is heat-treated. Then, while the steel sheet S passes through a snout and a zinc plating bath 110, molten zinc ZL is applied to the steel sheet S. At this time, gas wiping devices (air knives) 100 disposed in the zinc plating bath 110 blows gas (such as inert gas or air) to the surfaces of the steel sheet S so as to control (adjust) the thickness of a plating layer (that is, a zinc plating layer) formed on the steel sheet S by partially removing the plating layer.

Thereafter, the steel sheet S is carried along a cooling device, carrying rolls, and a plating measurement unit 130. The amount of plating measured when the steel sheet S passes through the plating measurement unit 130 is feedback to adjust a gas blowing pressure of the gas wiping devices 100 or the distances (gaps) between the gas wiping devices 100 and the steel sheet S to thus control the amount of plating (that is, the thickness of the plating layer) by a feedback method.

In FIG. 1, reference numerals 112 and 114 refer to a sink roll and a stabilizing roll for stretching a steel sheet S and adjusting tension of the steel sheet S.

The gas wiping devices 100 are main devices of plating equipment by which the thickness of a plating layer is mostly affected, and the thickness of a plating layer is a main factor determining the quality of plating.

Referring to FIG. 2, in each the gas wiping devices 100 illustrated in FIG. 1, a device nozzle 101 including upper and lower lips 103 and 104 forming a gas outlet 102 is attached to a device main body (chamber) 105 in the form of flanges F, and a high-pressure gas supply pipe 106 is connected to the device main body 105. In addition, a rectifying plate 107 and a mesh 108 may be disposed between the device main body 105 and the device nozzle 101.

As shown in FIG. 2, if a high-pressure gas (wiping jet J) discharged through the gas outlet 102 of the device nozzle 101 collides with a surface of a plated steel sheet S, the wiping jet J may be divided into upward and downward wall-surface jets J along the surface of the plated steel sheet S. Then, while the wall-surface jets J move rapidly along a hot-dip zinc plating layer ZL formed on the steel sheet S, the hot-dip zinc plating layer may be partially removed, and thus the amount of plating on the steel sheet S may be adjusted.

Recent steel sheet plating processes are required to form a thin plating layer on a steel sheet S while moving the steel sheet S at high speed so as to increase productivity. That is, if a steel sheet S is coated with a thin plating layer by performing a plating process only to a necessary degree, the manufacturing costs of the plated steel sheet S may be reduced, and the productivity of the plating process may be improved.

However, if a steel sheet is moved at high speed, each of the gas wiping devices 100 is required to discharge a wiping jet J having large momentum so as to thin a plating layer. That is, the gas pressure or flow rate of the gas wiping device 100 may need to be increased to increase the gas wiping capacity thereof.

As shown in FIG. 2, generally, the amount of plating on a steel sheet S is adjusted by varying the pressure of gas at the device nozzle 101 or the distance between the device nozzle 101 and the steel sheet S.

High productivity, for example, rapid formation of a thin plating layer, may be obtained by increasing the pressure or flow rate of wiping gas.

However, if the ability of wiping is improved by increasing the pressure or flow rate of gas for the rapid formation of a thin playing layer, the scattering of zinc particles P, known as splashing, may be increased as compared with the case of low-speed plating, and thus a large amount of top dross D may be formed above the surface of molten zinc of the plating bath 110.

That is, if the line speed of a steel sheet is increased and the pressure or flow rate of gas is accordingly increased for forming a thin plating layer with high productivity and low costs, scattering of particles is adversely increased. Therefore, there is a practical limit to increasing the line speed of a steel sheet.

For example, if the line speed of a steel sheet is 140 mpm in a plating process, dross may be generated at a rate of about 0.4 ton/hr because of scattered particles. However, if the line speed of a steel sheet is increased to 180 mpm in a plating process to increase the productivity of the plating process, the generation rate of dross may be markedly increased to about 1.4 ton/hr. That is, since a high line speed of a steel sheet requires a high pressure in wiping gas and markedly increases scattering of particles and the formation of dross, there is a limit to increasing the line speed of a steel sheet in a steel sheet plating process.

If the scattering of particles (i.e., scattering of zinc particles) increases, it may be difficult to perform a process at high speed in a continuous galvanizing line (CGL), and thus the productivity of the CGL may be lowered. Particularly, a steep increase in the amount of top dross D may cause contamination of devices such as rolls disposed in a plating bath or may worsen the plating quality of a steel sheet. Thus, an additional process may be necessary to remove such dross. However, this may increase the workload of workers.

DISCLOSURE

Technical Problem

Aspects of the present disclosure may provide an electromagnetic wiping device, a plated steel sheet wiping apparatus including the electromagnetic wiping device, and a method for manufacturing a plated steel sheet, which are designed to preliminarily remove a portion of a plating layer at least in an edge region of a steel sheet having passed through a plating bath and perform a gas wiping operation for preventing overplating at least in the edge region of the steel sheet, reducing gas wiping loads while maintaining the line speed of the steel sheet, reducing the quantity of scattered particles and dross, and improving the plating quality of the steel sheet and the productivity of a plating process.

Technical Solution

According to an aspect of the present disclosure, an electromagnetic wiping device may include: a device base disposed to a side of a steel sheet having passed through a plating bath; and an electromagnetic wiper disposed on the device base to generate a varying magnetic field for controlling a thickness of a plating layer formed on the steel sheet.

According to another aspect of the present disclosure, a plated steel sheet wiping apparatus may include: the electromagnetic wiping device; and a gas wiping device disposed above the electromagnetic wiping device.

According to another aspect of the present disclosure, a method for manufacturing a plated steel sheet may include: plating a steel sheet by passing the steel sheet through a plating bath; preliminarily removing a portion of a plating layer of the plated steel sheet by electromagnetic wiping; and adjusting a thickness of the plating layer of the plated steel sheet by partially removing a remaining portion of the plating layer by additional gas wiping.

Advantageous Effects

According to embodiments of the present disclosure, the electromagnetic wiping device is disposed between the lower side of the gas wiping device and a plating bath for preliminarily controlling the thickness of molten zinc attached to a steel sheet having passed through the plating bath by partially removing the molten zinc before a main gas wiping operation. Therefore, although the load of gas wiping is reduced, the thickness of a plating layer of a steel sheet may be properly controlled.

Therefore, according to the embodiments of the present disclosure, if other plating conditions are equal, the pressure or flow rate of gas in a gas wiping operation can be reduced as compared with the case of using only a gas wiping device in the related art. Therefore, the occurrence of splashing caused by scattered metal particles such as zinc particles, and the formation of top dross cased by the accumulation of scattered particles on molten zinc of the plating bath can be reduced.

Therefore, according to the embodiments of the present disclosure, the productivity of a manufacturing process can be improved while reducing the quantity of scattered particles or the formation of dross on molten zinc of the plating bath as compared with at least the case of using plating techniques of the related art. Therefore, the quality of plating or the lifespan of plating equipment can be improved.

Furthermore, since the position of the electromagnetic wiper can be controlled relative to the width of a steel sheet to prevent overplating at least in an edge region of the steel sheet, optimized plating conditions can be obtained.

BEST MODE FOR INVENTION

Hereinafter, embodiments of the present disclosure will be described with reference to the accompanying drawings.

Figure 2:
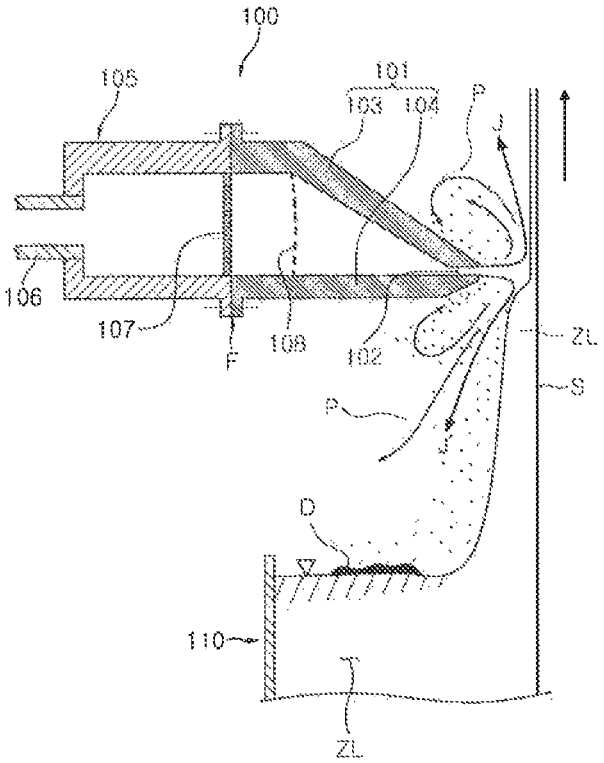
FIG. 2 is a view illustrating a gas wiping operation in the related art.
Figure 3A:
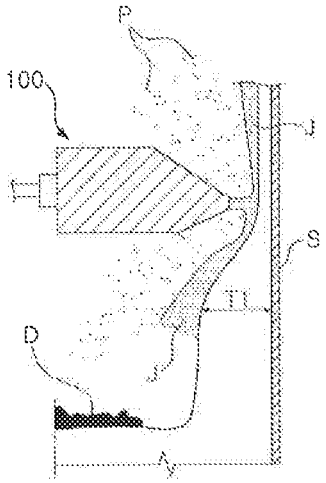
FIGS. 3A and 3B are a schematic view illustrating a gas wiping operation in the related art and a schematic view illustrating an operation in which electromagnetic pre-wiping and gas wiping are performed according to an embodiment of the present disclosure.
Figure 3B:
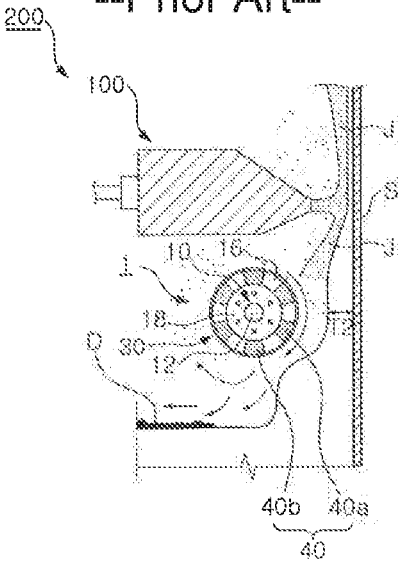

FIG. 3A illustrates a case in which the gas wiping device 100 illustrated in FIG. 2 is only used for removing a plating layer of a steel sheet S (adjusting the thickness of the plating layer), and FIG. 3B illustrates a case in which an electromagnetic wiping device 1 and the gas wiping device 100 are used together for adjusting the thickness of a plating layer of a steel sheet S according to an embodiment of the present disclosure.

Figure 1:
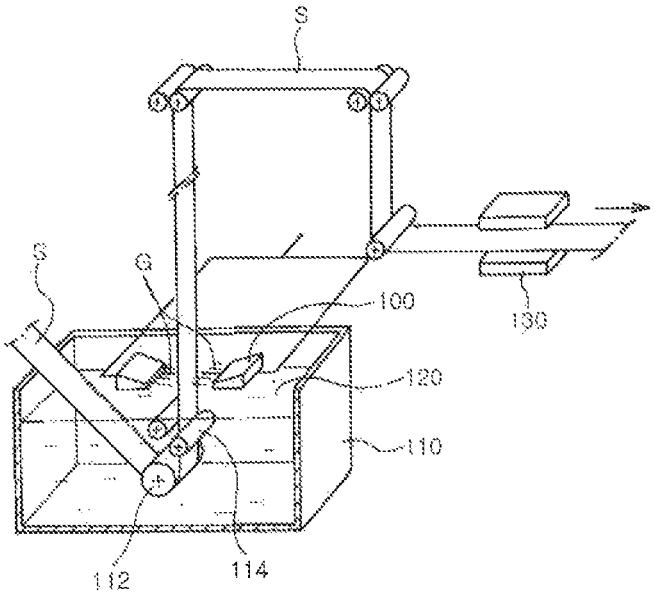
FIG. 1 is a view illustrating equipment for performing a plating process in the related art.

Since the gas wiping device 100 illustrated in FIGS. 3A and 3B is substantially the same as the gas wiping device 100 illustrated in FIGS. 1 and 2, the structure and operation thereof will not be described in detail.

For illustrative purposes only, the following description of the embodiment of the present disclosure will be given for the case in which a steel sheet S is galvanized while the steel sheet S passes through molten zinc ZL contained in the plating bath 110 shown in FIG. 1. However, the embodiment of the present disclosure is not limited to galvanization.

Figure 4:
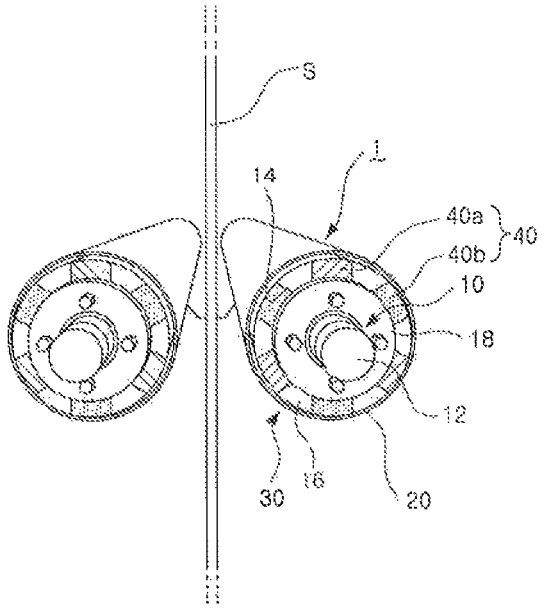
FIG. 4 is a perspective view illustrating an installed state of electromagnetic wiping devices according to an embodiment of the present disclosure.
Figure 5:
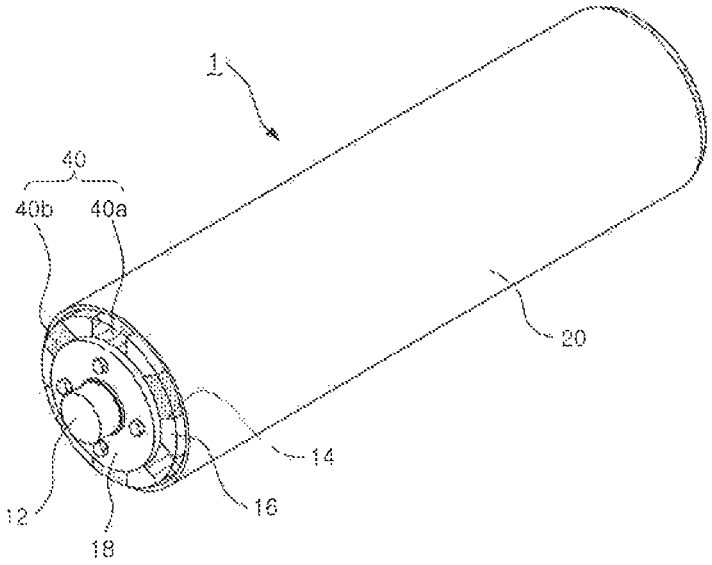
FIG. 5 is a perspective view illustrating an electromagnetic wiping device according to an embodiment of the present disclosure.
Figure 7:
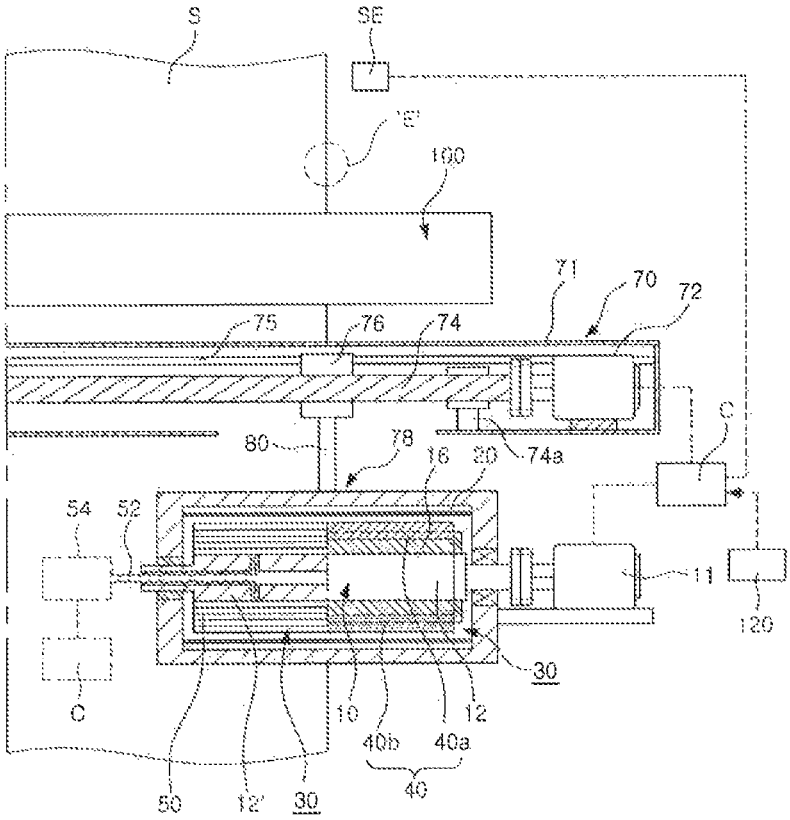
FIG. 7 is a front view illustrating an electromagnetic wiping device according to another embodiment of the present disclosure.

In the embodiments of the present disclosure, electromagnetic wiping devices 1 may be disposed adjacently to widthwise edges 'E' of a plated steel sheet as partially shown in FIG. 7. In addition, electromagnetic wiping devices 1 longer than the maximum width of a steel sheet may be disposed along the width of the steel sheet as shown in FIGS. 4 and 5, or a pair of electromagnetic wiping devices 1 may be disposed adjacently to each edge of a steel sheet as partially shown in FIG. 7.

Referring to FIG. 3B, a plating thickness adjusting apparatus 200 includes the electromagnetic wiping device 1 and the gas wiping device 100 for finally adjusting the thickness of a plating layer by a gas wiping method. The plating thickness adjusting apparatus 200 may be used in a process for plating a steel sheet.

In the following description of the embodiment of the present disclosure, elements of the gas wiping device 100 and the plating equipment illustrated in FIGS. 1 and 2 will be denoted by the same reference numerals, and descriptions thereof will be briefly given. In the accompanying drawings illustrating embodiments of the present disclosure, for clarity of illustration, it may be illustrated that only one electromagnetic wiping device 1 is disposed to a side of a steel sheet. However, actually, electromagnetic wiping devices 1 are disposed at both sides of a steel sheet in the embodiments of the present disclosure.

In an embodiment of the present disclosure, a steel sheet S may be plated using an electromagnetic wiping device and a plated steel sheet wiping apparatus through a plating process in which the steel sheet S is carried through the plating bath 110 (refer to FIG. 1) to plate the steel sheet S, a plating layer pre-removing process in which at least portions of a plating layer formed in edge regions of the steel sheet S are partially removed using the electromagnetic wiping device, and a plating layer thickness adjusting process in which the thickness of the plating layer is adjusted by gas wiping.

Therefore, in the embodiment of the present disclosure, since at least portions of a plating layer formed in edge regions of a steel sheet are first removed by electromagnetic wiping, although the same gas jet J is applied along the width of the steel sheet, overplating in the edge regions of the steel sheet may be prevented.

Since a plating layer surrounds edges of a steel sheet, overplating may be easily observed in edge regions of the steel sheet. However, according to the embodiment of the present disclosure, since electromagnetic wiping is performed on the entire width of a steel sheet or at least edge regions of the steel sheet so as to partially remove a plating layer, overplating may not occur in the edge regions of the steel sheet.

The plating layer pre-removing process and the plating layer thickness adjusting process may be performed using the electromagnetic wiping device 1 (described later in detail) and the gas wiping device 100 illustrated in FIGS. 1 and 2.

For example, as shown in FIGS. 1, 2, and 3A, if only the gas wiping device 100 is used, since a pre-removing process for preliminarily removing a zinc plating layer ZL from a steel sheet is not performed using the electromagnetic wiping device 1 shown in FIG. 3B, a thickness T1 of the zinc plating layer ZL to be partially removed by the gas wiping device 100 (refer to FIG. 3A) is greater than a thickness T2 of a zinc plating layer ZL (refer to FIG. 3B) which is obtained at the same position by preliminarily removing (pushing down) the zinc plating layer ZL from a steel sheet in a non-contact manner by using an electromagnetic field.

Therefore, the gas pressure (gas discharge pressure) or gas flow rate of the gas wiping device 100 may be greater in the case of FIG. 3A than in the case of FIG. 3B. Since scattering of zinc particles P is increased in proportion of the gas pressure, it is more difficult to increase the line speed of a steel sheet in the case of FIG. 3A.

However, as shown in FIG. 3B, in the case of using the plating thickness adjusting apparatus 200 that includes the electromagnetic wiping device 1 as an auxiliary wiping device and the gas wiping device 100 as a main wiping device, first, a zinc plating layer is partially removed by electromagnetic induction before the thickness of the zinc plating layer is finally adjusted by gas wiping. Thus, although the pressure and flow rate of gas are reduced in a main wiping region, the line speed of a steel sheet may be maintained at a value equal to the line speed of a steel sheet in FIG. 3A, and thus the quantity of scattered zinc particles P or the amount of top dross D formed above the surface of molten zinc of the plating bath 110 may be reduced.

In FIG. 7, two electromagnetic wiping devices 1 may be disposed adjacently to edges E of a steel sheet in the width direction of the steel sheet so as to preliminarily and partially remove a zinc plating layer from edge regions of the steel sheet in which the zinc plating layer is locally thick. In this case, overplating in the edge regions of the steel sheet may be prevented, and thus the amount of plating on the steel sheet may be properly adjusted.

As described above, according to the present disclosure, before final gas wiping is performed to adjust the thickness of a zinc plating layer, at least portions of the zinc plating layer may be properly removed by using the electromagnetic wiping device 1 illustrated in FIG. 3A which is longer than the width of a steel sheet or by using the electromagnetic wiping device illustrated in FIG. 7 which is disposed at each edge of a steel sheet. Therefore, top dross and splashing such as the scattering of zinc particles may be prevented. Along therewith, factors determining the ability of gas wiping (such as the pressure or flow rate of gas) may be lowered to increase the feeding speed (line speed) of a steel sheet.

FIGS. 4 to 7 illustrate the electromagnetic wiping device 1 according to embodiments of the present disclosure.

According to the embodiments of the present disclosure, the electromagnetic wiping device 1 may be disposed under the gas wiping device 100 above the plating bath 110 to partially cut down a zinc plating layer formed on a steel sheet by a non-contact electromagnetic method and thus to lower the load of a main gas wiping process performed for adjusting the thickness of the zinc plating layer. Accordingly, the quantity of scattered zinc particles P and the amount of top dross D may be reduced.

For example, the electromagnetic wiping device 1 of the embodiments may push (cut down) a portion of a zinc plating layer of a steel sheet in a direction opposite to the direction in which the steel sheet is moved, by using a current induced by a time-varying magnetic (electromagnetic) field.

Figure 12:
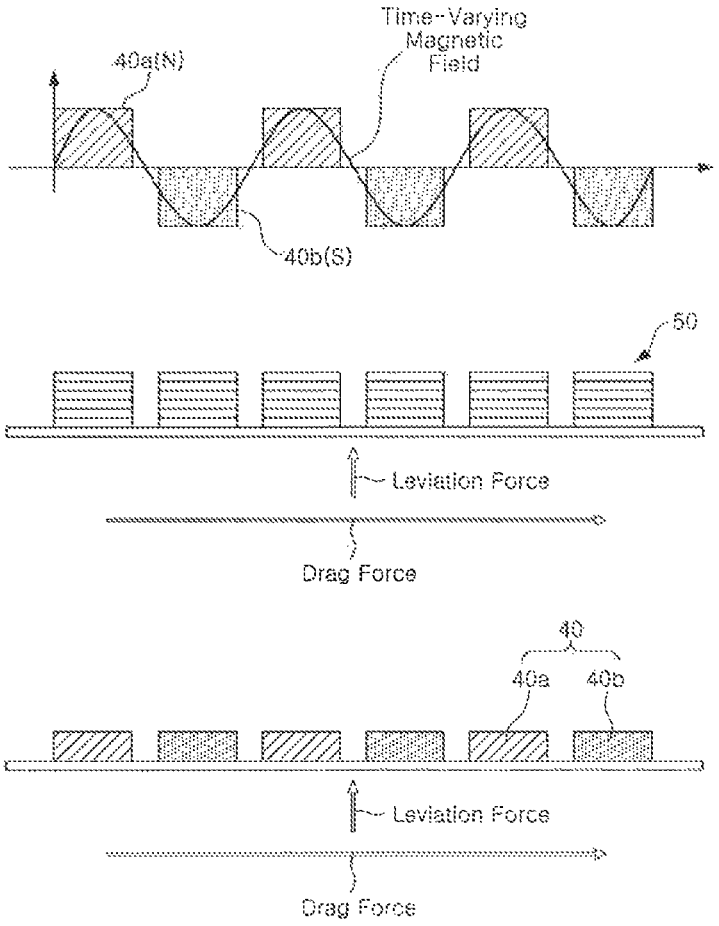
FIG. 12 is a schematic view illustrating how a diamagnetic substance generates drag force and levitation force in response to a current induced by a time-varying magnetic field.

That is, as shown in FIG. 12, if a single-phase alternating current or a three-phase alternating current is applied to electromagnets or electromagnet blocks 50 of the electromagnetic wiping device 1, or permanent magnets 40 (40*a* and 40*b*) of the electromagnetic wiping device 1 are rotated, one or both of drag force and levitation force are applied to a zinc plating layer, a diamagnetic substance, and thus, the zinc plating layer is partially cut down in a direction opposite to the moving direction of a steel sheet.

The electromagnet blocks 50 illustrated in FIG. 12 will be described later in detail. The permanent magnets 40 illustrated in FIG. 12 include N-pole permanent magnets 40*a* and S-pole permanent magnets 40*b* that are alternately arranged.

For example, drag force or levitation force may be applied to a zinc plating layer by using the electromagnets (electromagnet blocks) 50 or (rotating) permanent magnets 40 as shown in FIG. 12.

As shown in a graph of FIG. 12, if the permanent magnets 40 including the N-pole permanent magnets 40*a* and the S-pole permanent magnets 40*b* that are alternately arranged are rotated on a device base 10 (to be described later), a time-varying magnetic field is generated to induce a current, and thus drag force and levitation force are applied to a diamagnetic substance such as molten zinc (Zn) (and aluminum (Al) and copper (Cu)). In this case, levitation force is mainly generated rather than drag force until the permanent magnets 40 are rotated to a critical speed.

Alternatively, as shown in FIGS. 7 and 12, if an alternating current is applied to the electromagnet blocks 50 by using a pulse width modulator 54 (refer to FIG. 7), drag force and levitation force are applied to a zinc plating layer which is a diamagnetic substance. In this case, a proper alternating current may be applied to generate levitation force.

The magnitudes of the drag force and the levitation force may be controlled by varying the rotation speed of the permanent magnets 40. In addition, although the magnitude of the levitation force is small if a significantly high current is not applied to the electromagnets 50, the generation of the levitation force may be sufficiently controlled by applying a properly high alternating current.

When the permanent magnets 40 are used, drag force is mainly generated until the rotation speed of a rotation shaft 12 of the device base 10 reaches a critical value. On the other hand, when the electromagnets 50 are used, drag force and levitation force are generated according to an alternating current (applied by pulse width modulation (PWM)). That is, in the electromagnetic wiping device 1 of the embodiments of the present disclosure, permanent magnets or electromagnets may be selectively used according to plating conditions.

FIGS. 3B to 6 and FIG. 12 illustrate the case in which the electromagnetic wiping device 1 uses the permanent magnets 40 for mainly generating drag force before the rotation speed of the permanent magnets 40 reaches a critical value, and FIGS. 7 and 12 illustrate the case in which the electromagnetic wiping device 1 uses the electromagnets 50 for generating drag force and levitation force.

First, a description will be given of the case in which the electromagnetic wiping device 1 uses the permanent magnets 40.

As shown in FIGS. 4 to 7, the electromagnetic wiping device 1 of the present disclosure basically includes the device base 10 disposed to a side of a steel sheet S having passed through the plating bath 110, and an electromagnetic wiper 30 disposed on the device base 10 for controlling the thickness of a plating layer of the steel sheet S by varying a magnetic field.

That is, the electromagnetic wiping device 1 may include either the permanent magnets 40 or the electromagnets 50 so as to generate drag force and/or levitation force by a time-varying magnetic field for partially cutting a zinc plating layer formed on a steel sheet S down to the plating bath 110 by a non-contact electromagnetic method.

That is, the electromagnetic wiper 30 may include the permanent magnets 40 which are made up of the magnets 40*a* and 40*b* having different polarities and arranged on the device base 10 in a predetermined pattern, so as to partially remove a plating layer of a steel sheet by a non-contact method.

Alternatively, the electromagnetic wiper 30 may include one or more electromagnets 50, and a single-phase or three-phase alternating current may be applied to the device base 10 to generate a time-varying magnetic field around the electromagnets 50 and thus to partially remove a plating layer formed on a steel sheet by a non-contact method.

Referring to FIG. 7, to help understanding of the embodiments of the present disclosure, both the permanent magnets 40 and the electromagnets 50 are illustrated as being disposed on the rotation shaft 12 and a hollow support shaft 12' of the device base 10.

With reference to FIGS. 4 to 8, an explanation will now be given of the case in which the electromagnetic wiping device 1 uses the permanent magnets 40.

Figure 6:
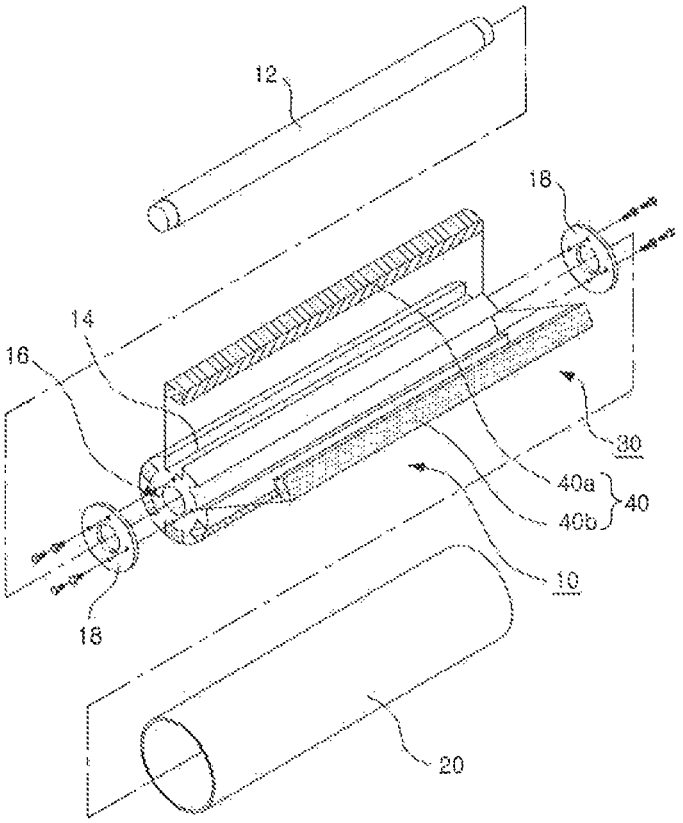
FIG. 6 is an exploded perspective view illustrating the electromagnetic wiping device illustrated in FIG. 5, according to the embodiment of the present disclosure.
Figure 8:
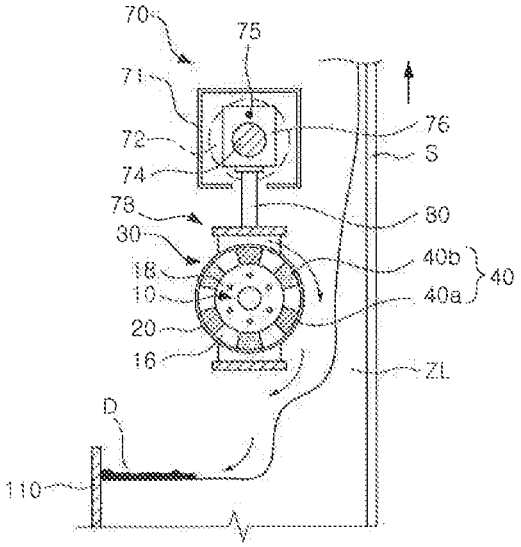
FIG. 8 is a side view illustrating the electromagnetic wiping device according to the other embodiment of the present disclosure.

Referring to FIGS. 6 to 8, the device base 10 of the electromagnetic wiping device 1 includes the rotation shaft 12 configured to be rotated by a motor 11 (refer to FIG. 7), and a rotation block 16 coupled to the rotation shaft 12. The permanent magnets 40*a* and 40*b* having different polarities are arranged on the rotation block 16 to a predetermined pattern.

In detail, magnet grooves 14 are formed along the circumference of the rotation block 16, and the (N-pole) permanent magnets 40*a* and the (S-pole) permanent magnets 40*b* are alternately disposed in the magnet grooves 14 and fixed to the magnet grooves 14.

The rotation shaft 12 penetrates a center region of the rotation block 16 and is fixed to the rotation block 16. Referring to FIGS. 6 and 7, the rotation shaft 12 is rotatably connected to a box-shaped horizontally movable structure 78 of a driving unit 70 (described later) by using bearings (not denoted by reference numerals), and the motor 11 is connected to the horizontally movable structure 78.

As shown in FIG. 7, if the rotation shaft 12 and the rotation block 16 of the device base 10, and the permanent magnets 40*a* and 40*b* are rotated together by operating the motor 11, drag force and levitation force are generated as explained with reference to FIG. 12 (the levitation force is generated after the rotation speed of the permanent magnets 40*a* and 40*b* becomes greater than a critical value).

Then, as shown in FIGS. 3B and 8, before a main gas wiping operation, a portion of a zinc plating layer formed on a steel sheet may be cut down by at least the drag force by a non-contact electromagnetic method.

As shown in FIG. 6, fixing plates 18 may be coupled to both sides of the rotation shaft 12 and the rotation block 16 by using bolts to prevent separation of the permanent magnets 40*a* and 40*b* from the magnet grooves 14.

Furthermore, the permanent magnets 40*a* and 40*b* may be fixed to the magnet grooves 14 using an adhesive (not shown), and then the fixing plates 18 may be coupled to both sides of the rotation block 16 using bolts.

In addition, the electromagnetic wiping device 1 may include a cover 20 covering the permanent magnets 40*a* and 40*b*. The cover 20 may have a surface roughness value in a certain range so that zinc particles may not easily attached thereto, or the cover 20 may be formed of a nonmagnetic material such as a heat-resistant ceramic material.

As shown in FIG. 7, the cover 20 may be fixed to the horizontally movable structure 78 or the outside of the rotation block 16. Owing to the cover 20, accumulation of scattered zinc particles on the permanent magnets 40*a* and 40*b* may be reduced or prevented.

FIG. 7 also illustrates the case in which the electromagnetic wiping device 1 uses the electromagnets 50. In detail, the case of using the electromagnets 50 and the case of using the permanent magnets 40 are illustrated on left and right sides of FIG. 7, respectively. Practically, the electromagnetic wiping device 1 may selectively include the electromagnets 50 or the permanent magnets 40.

As shown in FIG. 7, the electromagnets 50 having a block shape may be arranged on the hollow support shaft 12' of the device base 10 to form a ring pattern.

The electromagnets 50 are arranged on the hollow support shaft 12' due to the following reasons. Unlike the permanent magnets 40, the electromagnets 50 are not rotated, and a single-phase or three-phase alternating current is applied to the electromagnets 50 to generate drag force and levitation force as explained with reference to FIG. 12. Therefore, cables 52 for applying an alternating current to the electromagnets 50 may be disposed in the hollow support shaft 12'.

In this case, as shown in FIG. 7, the cables 52 connected to the electromagnets 50 are connected to the pulse width modulator 54 connected to a device control unit C. The pulse width modulator 54 schematically shown in FIG. 7 may be disposed on the driving unit 70 so that the movement of the electromagnetic wiping device 1 in the width direction of a steel sheet may not be blocked by the pulse width modulator 54.

If a single-phase or three-phase alternating current is applied to the electromagnets 50 from the pulse width modulator 54, a time-varying magnetic field is formed as shown in FIG. 12, and thus drag force and levitation force are generated to push down a portion of a zinc plating layer of a steel sheet in a non-contact manner.

Next, if the electromagnetic wiping device 1 is longer than the maximum width of a steel sheet as shown in FIGS. 7 and 8, the electromagnetic wiping device 1 may partially remove a zinc plating layer from the entire width of the steel sheet. If a pair of electromagnetic wiping devices 1 are disposed adjacently to edges E of a steel sheet as partially shown in FIG. 7, the electromagnetic wiping devices 1 may prevent overplating at least in edge regions of the steel sheet.

If the electromagnetic wiping device 1 is used together with the driving unit 70, the electromagnetic wiping device 1 may be moved relative to an edge of a steel sheet in the width direction of the steel sheet. That is, the position of the electromagnetic wiping device 1 may be controlled in the width of the steel sheet.

For example, as shown in FIGS. 7 and 8, the position of the electromagnetic wiping device 1 may be controlled in the width of a steel sheet by using the driving unit 70.

The driving unit 70 includes a movable block 76 coupled to a screw bar 74 which is longer than the maximum width of a plated steel sheet, and a motor 72 is coupled to a side of the screw bar 74.

Although not shown in FIG. 7, the motor 72 and the screw bar 74 may be fixed to an equipment frame horizontally disposed between the plating bath 110 (refer to FIG. 1) and the gas wiping device 100.

Therefore, as shown in FIGS. 7 and 8, according to the rotation direction of the motor 72, the movable block 76 coupled to the screw bar 74 by a screw coupling method may be moved to the right or left when viewed from the front side.

In this case, a guide rod 75 may be inserted through the movable block 76 to guide and support the movement of the movable block 76 and bear the weight of the electromagnetic wiping device 1 connected to a lower side of the movable block 76.

In addition, as shown in FIGS. 7 and 8, the horizontally movable structure 78 having a box shape is connected to the lower side of the movable block 76 through a connection member 80, and the above-described rotation shaft 12 or the hollow support shaft 12' may be disposed in the horizontally movable structure 78.

Therefore, if the motor 72 of the driving unit 70 is operated, the movable block 76 is moved along the screw bar 74 while being guide by the guide rod 75 in the width direction of a steel sheet, and thus the electromagnetic wiping device 1 disposed in the horizontally movable structure 78 may be moved closed to an edge E of the steel sheet although the width of the steel sheet is varied.

That is, at least the device base 10 and the electromagnetic wiper 30 of the electromagnetic wiping device 1 may be controlled according to the width direction of a steel sheet so as to be positioned close to an widthwise edge of a steel sheet, and thus overplating may be prevented in an edge region of the steel sheet.

In addition, as shown in FIGS. 7 and 8, a support structure 71 having a box shape may surround the screw bar 74 and the guide rod 75 of the driving unit 70, an opening (not denoted by a reference numeral) may be formed in a lower side of the support structure 71. The length of the opening may be determined according to the moving range of the connection member 80.

As shown in FIGS. 7 and 8, for example, the support structure 71 may be formed by bending a steel sheet in a box shape and welding the steel sheet and may have a length greater than the maximum width of a steel sheet, and the motor 72 connected to the screw bar 74 may be disposed in the support structure 71. The screw bar 74 may be supported by bearing blocks 74*a* disposed at both sides of the support structure 71 and may be rotated by the motor 72. If the screw bar 74 is rotated, the movable block 76 and the horizontally movable structure 78 may be moved.

The guide rod 75 may penetrate an upper portion of the movable block 76 having a rectangular shape, and both ends of the guide rod 75 may be coupled to both sidewalls of the support structure 71.

In this case, as shown in FIG. 7, the motor 11 of the electromagnetic wiper 30 including the permanent magnets 40, and the motor 72 of the driving unit 70 may be connected to the device control unit C through a power supply PS. In addition, the device control unit C may be electrically connected to the plating measurement unit 120 (refer to FIG. 1), a line speed sensor SE configured to sensing the line speed of a steel sheet, and the pulse width modulator 54 configured to apply an alternating current to electromagnets. Then, an electromagnetic wiping operation using the permanent magnets 40 or the electromagnets 50 may be controlled by the device control unit C based on a final plating layer thickness and the line speed of a steel sheet, and thus the thickness of a plating layer may be appropriately controlled.

Figure 9:
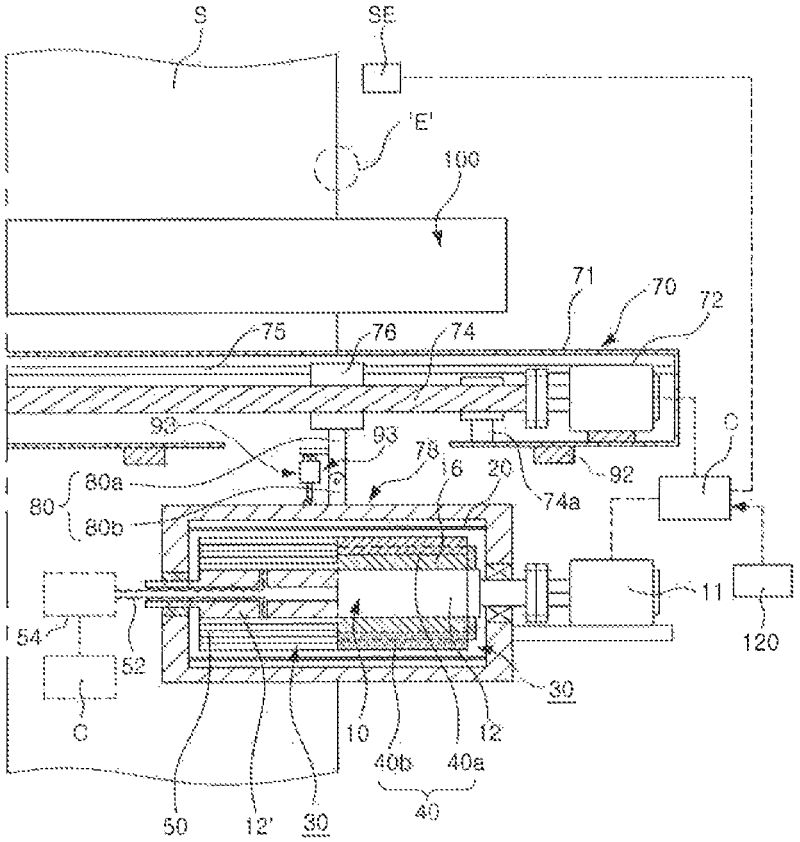
FIG. 9 is a view illustrating front and lateral sides of an electromagnetic wiping device according to another embodiment of the present disclosure.
Figure 10:
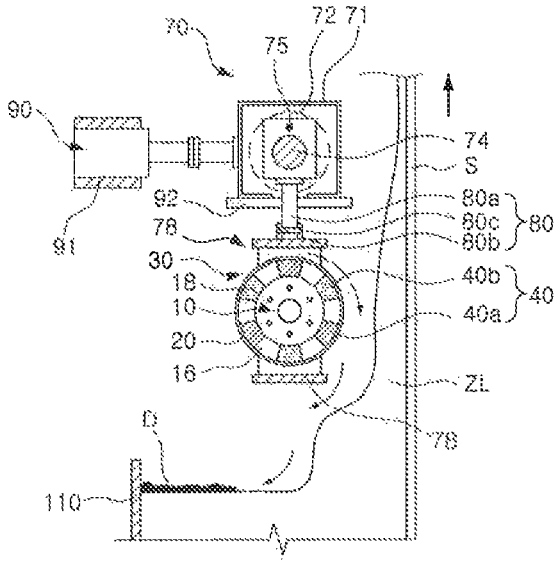
FIG. 10 is a view illustrating front and lateral sides of the electromagnetic wiping device according to the other embodiment of the present disclosure.
Figure 11:
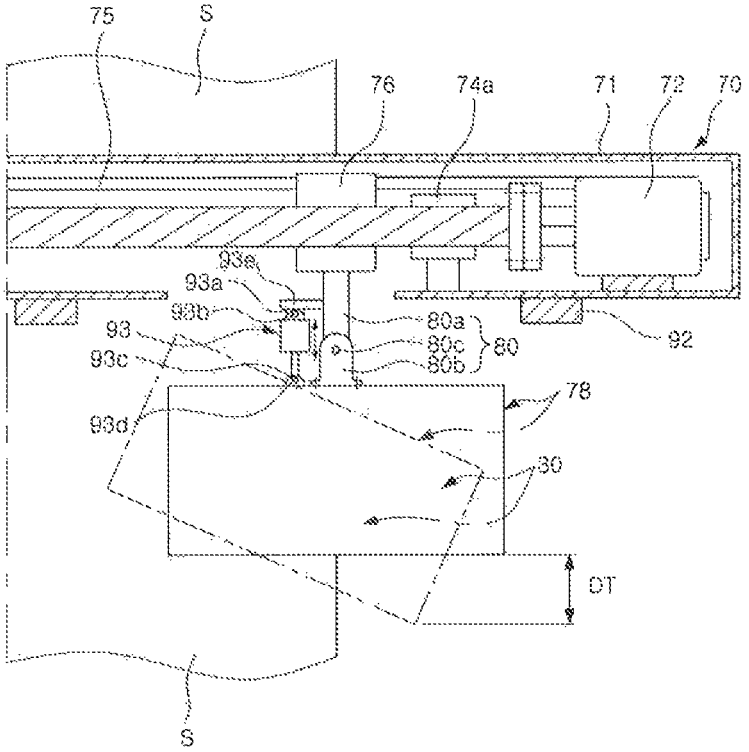
FIG. 11 is a view illustrating an operational state of the electromagnetic wiping device illustrated in FIGS. 9 and 10 according to the other embodiment of the present disclosure.

Next, another example of the electromagnetic wiping device illustrated in FIGS. 7 and 8 is illustrated in FIGS. 9 to 11.

Referring to FIGS. 9 to 11, the support structure 71 having a box shape is connected to a second driving unit 90 such as a horizontal driving cylinder, and a guide rail 92 is fixed to the equipment frame (not shown) across a lower side of the support structure 71. Then, the support structure 71 may be moved forwards or backwards along the guide rail 92 according to a forward or backward movement of the second driving unit 90 which is a horizontal driving cylinder.

Therefore, the electromagnetic wiper 30 connected to the lower side of the support structure 71 may be moved forwards or backwards. That is, the distance between the electromagnetic wiper 30 and a steel sheet S may be adjusted by moving the second driving unit 90, a horizontal driving cylinder, forwards or backwards.

Under the same electromagnetic conditions, the quantity of a plating layer removed from a steel sheet may be controlled by adjusting the distance between the electromagnetic wiper 30 and the steel sheet. Therefore, the quantity of a plating layer on a steel sheet may be controlled more precisely by electromagnetic wiping.

Referring to FIGS. 10 and 11, the horizontally movable structure 78 may be rotated by a third driving unit 93 in the moving direction of a steel sheet (for example, counterclockwise or clockwise with respect to a vertically moving steel sheet). In this case, when the electromagnetic wiper 30 partially removes a plating layer from at least an edge region of a steel sheet before a gas wiping operation, the operation of the electromagnetic wiper 30 may be controlled by adjusting the angle of the electromagnetic wiper 30.

For example, as shown in FIG. 11, the angle of the electromagnetic wiper 30 to an edge of a steel sheet may be adjusted by moving the third driving unit 93 forward or backward to rotate the horizontally movable structure 78 together with the electromagnetic wiper 30.

In this case, as shown in FIG. 11, the connection member 80 may include upper and lower link members 80*a* and 80*b* that are connected together by a hinge 80*c*. In addition, the upper link member 80*a* and the lower link member 80*b* may be fixed to the lower side of the movable block 76 and the upper side of the horizontally movable structure 78, respectively.

The third driving unit 93 being a vertical driving cylinder is connected to a bracket 93*e* of the upper link member 80*a* of the connection member 80 through a hinge 93*b*, and a rod of the third driving unit 93 is connected to an upper bracket 93*d* of the horizontally movable structure 78 through a hinge 93*c*. Therefore, if the third driving unit 93 is operated forward or backward, the horizontally movable structure 78 is rotated counterclockwise or clockwise from an edge of a steel sheet S when viewed from the front side as shown in FIG. 11. At this time, the horizontally movable structure 78 is rotated on the hinge 80*c* connecting the upper and lower link members 80*a* and 80*b* of the connection member 80.

Therefore, if the horizontally movable structure 78 is rotated as described above, the electromagnetic wiper 30 may partially remove a plating layer from an edge region of a steel sheet at a position advanced by a distance DT before a gas wiping operation is performed. That is, the more the electromagnetic wiper 30 is rotated, the earlier the plating layer of a steel sheet may be partially removed. Thus, the quantity of a plating layer removed from a steel sheet may be controlled by adjusting the rotation (slope) of the electromagnetic wiper 30.

Accordingly, as shown in FIG. 11, the amount of plating on a steel sheet may be precisely controlled using the electromagnetic wiping device of the embodiment of the present disclosure by adjusting the distance between the electromagnetic wiper 30 and the steel sheet and the angle of the electromagnetic wiper 30 with respect to an edge of the steel sheet by using the second driving unit 90 and the third driving unit 93. Thereafter, the thickness of a plating layer may be optimally adjusted by controlling a gas wiping operation.

As described above, before a gas wiping operation, a plating layer formed on a steel sheet in a plating bath may be partially removed from the entire width of the steel sheet. Particularly, since the amount of plating on a steel sheet is larger in edge regions of the steel sheet than in a center region of the steel sheet, a plating layer may be partially removed from at least the edge regions of the steel sheet before a gas wiping operation.

In this case, it may be preferable that the quantity of a plating layer removed from an edge region of a steel sheet be 5% to 25% of the quality of the plating layer of the steel sheet in a center region of the steel sheet.

For example, if a steel sheet is moved at a rate of 120 mpm, the density of a plating layer formed on the steel sheet may about 400 g/m$^2$ in a center region of the steel sheet and about 440 g/m$^2$ to about 500 g/m$^2$ in an edge region of the steel sheet.

In this case, if the quantity of the plating layer removed from the edge region is less than 5% of the quantity of the plating layer formed in the center region of the steel sheet, the pressure of gas may not be reduced in a later gas wiping operation due to an insufficiently removed amount. On the other hand, if the quantity of the plating layer removed from the edge region is greater than 25% of the quantity of the plating layer formed in the center region of the steel sheet, due to an excessively removed amount, it may be difficult to make the thickness of the plating layer uniform across the center region to the edge region of the steel sheet in a later gas wiping operation.

More preferably, the quality of a plating layer removed from an edge region of a steel sheet may be 10% to 20% of the quality of the plating layer formed in a center region of the steel sheet.

According to the embodiments of the present disclosure, since a plating layer is partially removed from edge regions of a steel sheet in advance, overplating may not occur at least in the edge regions of the steel sheet.

After a steel sheet passes through a plating bath, the quality of a plating layer may be larger in edge regions of the steel sheet than in a center region of the steel sheet. In addition, the plating layer may be flat in the center region of the steel sheet but may be curved in the edge regions of the steel sheet because the plating layer surrounds the edges of the steel sheet. Therefore, it may be difficult to reduce overplating in the edge regions of the steel sheet through a gas wiping operation.

However, according to the embodiments of the present disclosure, since a plating layer is partially removed from at least edge regions of a steel sheet in advance by using the electromagnetic wiping device 1, the thickness of the plating layer may be uniform across the width of the steel sheet after a gas wiping operation. In the present disclosure, an edge region of a steel sheet from which a plating layer is partially removed in advance may be defined from an edge of the steel sheet to a position of the steel sheet spaced apart from the edge by 100 mm to 300 mm, for example, about 200 mm.

INDUSTRIAL APPLICABILITY

If a steel sheet is plated using the electromagnetic wiping device 1 of the present disclosure, since a plating layer is partially removed at least in edge regions of the steel sheet in advance, the pressure of gas in a later gas wiping operation may be reduced by about 20% to about 30%, and thus scattering of zinc particles and the formation of top dross on a plating bath may be suppressed even thought the steel sheet is moved at the same speed.

The invention claimed is:

1. An electromagnetic wiping device comprising:

a device base disposed to a side of a steel sheet having passed through a plating bath; and an electromagnetic wiper disposed on the device base to generate a varying magnetic field for controlling a thickness of a plating layer formed on the steel sheet;

wherein the device base is pairwise disposed adjacent to either edge of the steel sheet to correspond to the width of the steel sheet, and is rotatable in a moving direction of the steel sheet so that a portion adjacent to a center portion of the steel sheet, and wherein the electromagnetic wiper is rotatable with the device base is forwardly located in the moving direction of the steel sheet, rather than a portion adjacent to an edge portion of the steel sheet.

2. The electromagnetic wiping device of claim 1, wherein positions of the device base and the electromagnetic wiper are controlled in a width direction of the steel sheet by using a driving unit.

3. The electromagnetic wiping device of claim 1, wherein the driving unit comprises:

a movable block disposed in a support structure and coupled to a screw bar, the screw bar extending in the width direction of the steel sheet and configured to be driven by a motor; and a horizontally movable structure connected to a lower side of the movable block through a connection member, the device base and the electromagnetic wiper being disposed in the horizontally movable structure.

4. The electromagnetic wiping device of claim 3, wherein the support structure is movable forward and backward by a second driving unit so as to adjust a distance between the electromagnetic wiper and the steel sheet, and the horizontally movable structure is rotatable by a third driving unit in a moving direction of the steel sheet so as to further suppress overplating in the edge region of the steel sheet.

5. The electromagnetic wiping device of claim 4, wherein the second driving unit is a horizontal driving cylinder connected to the support structure, the support structure is supported on a guide rail, the connection member is connected to the horizontally movable structure and comprises link members connected to each other by a hinge, and the link members are connected respectively to the movable block and the horizontally movable structure, wherein the third driving unit is a vertical driving cylinder connected between the movable block and the horizontally movable structure.

6. The electromagnetic wiping device of claim 3, further comprising a nonmagnetic cover covering the electromagnetic wiper.

7. The electromagnetic wiping device of claim 1, wherein the electromagnetic wiper comprises permanent magnets having different polarities and arranged on the device base to form a predetermined pattern, wherein the device base on which the permanent magnets are arranged comprises:

a rotation shaft extending in the width direction of the steel sheet and configured to be driven by a motor; and a rotation block coupled to the rotation shaft, the permanent magnets having different polarities are disposed on the rotation block to form the predetermined pattern.

8. The electromagnetic wiping device of claim 1, wherein the electromagnetic wiper comprises one or more electromagnets disposed on the device base to generate a time-varying magnetic field when a single-phase or three-phase alternating current is applied to the electromagnets, wherein the device base comprises a hollow support shaft extending in the width direction of the steel sheet, and the electromagnets are disposed on the hollow support shaft and are connected to a pulse width modulator through cables lying in the hollow support shaft.

* * * * *